US008336999B2

(12) United States Patent
Matsumoto et al.

(10) Patent No.: US 8,336,999 B2
(45) Date of Patent: Dec. 25, 2012

(54) LIQUID SUPPLY METHOD

(75) Inventors: Hitoshi Matsumoto, Nagano-ken (JP); Toshio Kumagai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 196 days.

(21) Appl. No.: 12/858,620

(22) Filed: Aug. 18, 2010

(65) Prior Publication Data

US 2011/0050766 A1 Mar. 3, 2011

(30) Foreign Application Priority Data

Sep. 2, 2009 (JP) ..... 2009-202339

(51) Int. Cl.
*B41J 2/175* (2006.01)

(52) U.S. Cl. ..... 347/85

(58) Field of Classification Search ..... 347/7, 84, 347/85

See application file for complete search history.

(56) References Cited

U.S. PATENT DOCUMENTS 6,390,611 B1 5/2002 Kobayashi et al.
7,344,231 B2 * 3/2008 Talon et al. ..... 347/85

FOREIGN PATENT DOCUMENTS

JP 2000-211152 8/2000

* cited by examiner

*Primary Examiner* — An Do

(57) ABSTRACT

A liquid supply method of a liquid ejecting apparatus including a tank having a liquid capacity greater than a storage amount of the liquid which is stored in a liquid storage unit, and a liquid ejection unit that ejects the liquid supplied from the tank side includes the steps of: firstly supplying all the liquid in the liquid storage unit to the tank; agitating the liquid accommodated in the tank; and secondly supplying the liquid in the tank to the liquid ejection unit.

8 Claims, 6 Drawing Sheets

LIQUID SUPPLY METHOD

CROSS-REFERENCE TO RELATED APPLICATIONS

Japanese Patent Application No. 2009-202339, filed Sep. 2, 2009, is hereby incorporated by reference in its entirety.

BACKGROUND

1. Field of Invention

The present invention relates to a liquid supply method for supplying a liquid, such as ink, from a liquid storage unit for storing the liquid to a liquid ejection unit.

2. Description of Related Art

Until now, an ink jet-type printer (hereinafter referred to as "printer") disclosed in JP-A-2000-211152 has been proposed as a liquid ejecting apparatus capable of supplying a liquid from a liquid storage unit for storing the liquid to a liquid ejection unit. The printer disclosed in JP-A-2000-211152 includes a recording head serving as a liquid ejecting unit for ejecting ink as the liquid onto a target such as recording paper, and a sub-tank for temporarily accommodating the ink to be supplied to the inside of the recording head. The inside of the sub-tank is supplied with the ink from an ink cartridge, which serves as a liquid storage unit, via an ink supply tube.

Recently, as the ink to be ejected onto the target, UV (Ultra Violet) ink which is cured by irradiation of ultraviolet rays has been used. A portion of the ink component may be easily settled in the ink cartridge which stores the high viscosity ink, such as UV ink. For this reason, a component ratio of the ink supplied to the recording head via the sub-tank from the ink cartridge may vary slightly whenever a process of supplying the ink from the ink cartridge side is performed. Accordingly, a variation occurs in the component ratio of the ink ejected from the recording head, and, as a result, it is difficult to constantly maintain the quality of a product (i.e., a target of printing completion) made by ejecting the ink onto the target.

In addition, if the ink is accommodated in the sub-tank for a long time, a portion of the ink component may be settled in the sub-tank. In a case where the ink is supplied to the recording head side from the sub-tank in this state, a variation may occur in the component ratio of the ink which is ejected from the recording head.

SUMMARY OF INVENTION

An advantage of some aspects of the invention is that it provides a liquid supply method which can supply a liquid having a uniform component ratio to a liquid ejection unit.

According to an aspect of the invention, there is provided a liquid supply method of a liquid ejecting apparatus including a tank having a liquid capacity greater than a storage amount of the liquid which is stored in a liquid storage unit, and a liquid ejection unit that ejects the liquid supplied from the tank side, the liquid supply method including the steps of: firstly supplying all the liquid in the liquid storage unit to the tank; agitating the liquid accommodated in the tank; and secondly supplying the liquid in the tank to the liquid ejection unit.

With the above configuration, all the liquid stored in the liquid storage unit is supplied to the tank. The agitation of the liquid supplied to the tank suppresses a portion of the liquid components from settling in the tank. The liquid, for which the agitation is completed, is supplied to the liquid ejecting unit side. Accordingly, it is possible to supply the liquid having a uniform component ratio to the liquid ejection unit.

In the liquid supply method according to the invention, the tank is configured to have a size which can accommodate all the liquid in the liquid storage unit in a case where an capacity of the liquid in the tank is equal to or less than an amount approximate to a predetermined upper limit, and wherein the liquid supply method further includes the steps of detecting the capacity of the liquid in the tank; and the step of firstly supplying is executed in a case where a detection result at the step of detecting the capacity is equal to or less than the approximate amount of the predetermined upper limit.

With the configuration, in a case where the tank is provided with a space for accommodating all the liquid in the liquid storage unit, all the liquid is supplied from the inside of the liquid storage unit. Meanwhile, in a case where the tank is not provided with a space for accommodating all the liquid in the liquid storage unit, the supply of the liquid from the inside of the liquid storage unit is restricted. For this reason, it is possible to supply the liquid having a uniform component ratio to the liquid ejection unit.

In the liquid supply method according to the invention, the liquid ejecting apparatus includes another tank disposed between the tank and the liquid ejection unit in the liquid supply direction, and wherein the liquid supply method further includes the step of detecting a residual amount of the liquid accommodated in the other tank; and in the step of secondarily supplying, the liquid in the tank is supplied to the another tank based on the detection result at the step of detecting the residual amount.

With the configuration, based on the residual amount of the liquid in another tank, the liquid of the tank is supplied to another tank, and then the liquid of another tank is supplied to the liquid ejecting unit. That is, in a case where it is necessary to supply the liquid to another tank, the supply of the liquid from the tank to another tank is performed.

In the liquid supply method according to the invention, the tank is configured to have a size which can accommodate all the liquid in the liquid storage unit in a case where the capacity of the liquid in the tank is equal to or less than the approximate amount of the predetermined upper limit, and wherein the liquid supply method further includes the step of detecting the capacity of the liquid in the tank; and the step of secondarily supplying is executed in preference to the step of firstly supplying, when it is determined that supply of the liquid to another tank is necessary based on the detection result at the step of detecting the residual amount, in a case where the detection result at the step of detecting the capacity is equal to or less than the approximate amount of the predetermined upper limit.

With the configuration, after the liquid is supplied to the tank from the liquid storage unit, bubbles may be mixed with the liquid in the tank according to the supply of the liquid to the tank. For this reason, in a case where the supply timing of the liquid to the tank is overlapped with the supply timing of the liquid to another tank, the supply of the liquid to another tank is carried out first. Therefore, it is possible to suppress the supply of the liquid mixed with bubbles to another tank side from the tank.

In the liquid supply method according to the invention, the step of agitating is executed before an elapsed time, after the step of agitating is last executed, lapses a predetermined elapsed time threshold value.

With the configuration, if the liquid in the tank is not periodically agitated, a portion of components of the liquid may be settled in the tank. For this reason, it is preferable to solve the problem that a portion of the components of the liquid has settled in the tank by executing the agitation step periodically.

In the liquid supply method according to the invention, the step of agitating is executed at least one timing of a time that electric power is supplied to the liquid ejecting apparatus or a time that the liquid is supplied to the tank from the liquid storage unit.

Before the input of electric power, a portion of the components of the liquid may be settled in the tank. Accordingly, in the invention, the problem that sedimentation has occurred in the tank is preferably solved when the electric power is applied. In addition, after the liquid is supplied to the tank, the component ratios of the liquid may be different at each position in the inside of the tank. Accordingly, in this embodiment, the agitation process is carried out at the time liquid is supplied to the tank. Therefore, it is possible to supply the liquid with the uniform component ratio to the liquid ejection unit side.

In the liquid supply method according to the invention, the step of secondarily supplying is regulated when an elapsed time, after the step of agitating is completed, is less equal to or less than a predetermined regulated time threshold value.

With the configuration, when the liquid is agitated in the tank, the liquid may be mixed with bubbles. Accordingly, in a case where the elapsed time, after the agitation is completed, is equal to or less than a regulated time-threshold value, the supply of the liquid from the liquid ejection unit side to the tank is regulated. Therefore, it is possible to suppress the supply of the liquid mixed with bubbles to the liquid ejection unit side.

In the liquid supply method according to the invention, in the step of firstly supplying, in a case where the liquid storage unit is mounted on a holder of the liquid ejecting apparatus, all the liquid in the liquid storage unit mounted on the holder is supplied to the tank, and in a case where the liquid storage unit is not mounted on a holder of the liquid ejecting apparatus, notification of prompting a user to mount the liquid storage unit on the holder is carried out.

With the configuration, in a case where the liquid storage unit is not mounted on the holder at the timing of supplying the liquid to the tank, the notification of prompting the user to mount the liquid storage unit is carried out.

Other objects and attainments together with a fuller understanding of the invention will become apparent and appreciated by referring to the following description and claims taken in conjunction with the accompanying drawings.

BRIEF DESCRIPTION OF THE DRAWINGS

The invention will be described with reference to the accompanying drawings, wherein like numbers reference like elements.

DESCRIPTION OF THE PREFERRED EMBODIMENTS

One embodiment of the invention will be described with reference to FIGS. 1 to 6.

Figure 1:
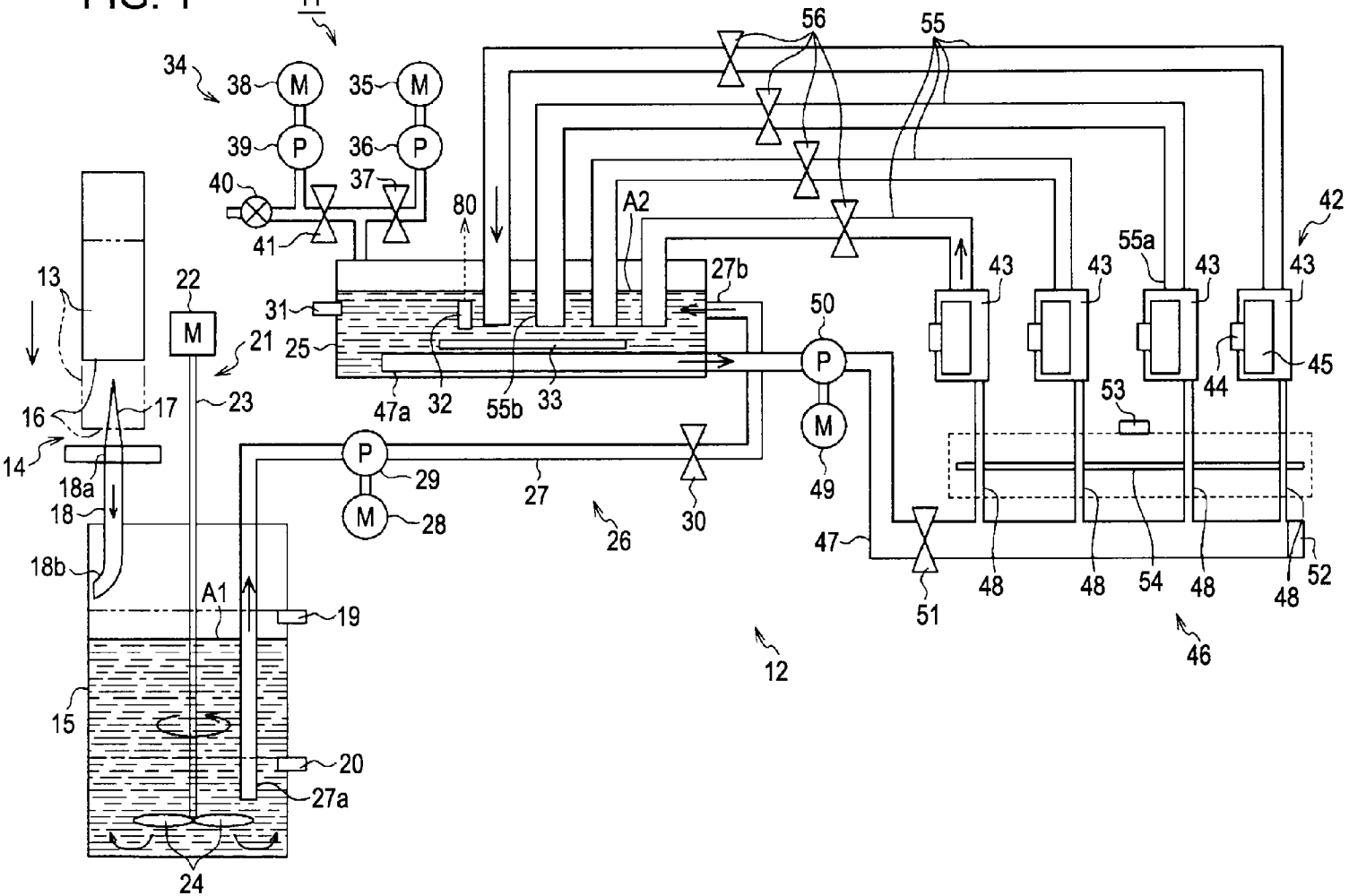
FIG. 1 is a diagram schematically illustrating the configuration of an ink jet-type printer according to an embodiment of the invention.

As shown in FIG. 1, an ink jet-type printer 11 (hereinafter referred to as a "printer") serving as a liquid ejecting apparatus includes a printing section 12 capable of performing a printing process with respect to a target (e.g., a film or glass plate), which is not illustrated, by using UV (Ultra Violet) ink (ultraviolet curable ink) as one example of a liquid. In addition, the printer 11 of this embodiment is provided with an irradiation unit (not illustrated) that irradiates ultraviolet rays onto the target, on which the printing is completed by the printing section 12, to cure the UV ink landed on the target. In this instance, the UV ink contains a pigment component with low dispersion stability, and also has a property of such that the pigment component is easily settled.

The printing section 12 includes a holder 14 on which an ink cartridge 13 serving as a liquid storage unit for storing the UV ink is mounted, and a main tank 15 formed in a substantially cylindrical shape having a bottom surface and located below the holder 14 in the direction of gravity. The holder 14 is provided with a hollow ink supply needle 17 which can be attached to or detached from a derivation portion 16 of the ink cartridge 13 which is located at a mounting position indicated by a double-dotted chain line in FIG. 1. In addition, the holder 14 is connected to a first ink supply tube 18 serving as a liquid connection passage. The upstream end portion 18*a* of the first ink supply tube 18 is communicated with the inside of the ink supply needle 17 as a liquid connection passage, and the downstream end portion 18*b* of the first ink supply tube 18 is located in the inside of the main tank 15. The main tank 15 is configured in such a way that the capacity of the UV ink is sufficiently larger than the storage amount of the UV ink in the ink cartridge 13. The side wall of the main tank 15 is provided with a plurality (two in this embodiment) of main-side residual amount sensors 19 and 20 for detecting the residual amount of the UV ink in the main tank 15 based on the position of a liquid level A1 of the UV ink. Each of the main-side residual amount sensors 19 and 20 is located at a different position in the direction of gravity.

In addition, the printing section 12 is provided with an agitation device 21 serving as an agitating unit for agitating the UV ink accommodated in the main tank 15. The agitation device 21 includes an agitation motor 22 serving as a driving source, a shaft member 23, serving as a rotation axis, which is rotated by the driving of the agitation motor 22, and a plurality (only two illustrated in FIG. 1) of blade members 24 installed at the front end (the lower end in FIG. 1) of the shaft member 23.

In addition, the printing section 12 is provided with a sub-tank 25 as another tank, of which the capacity of the UV ink is equal to or less than that of the main tank 15, and a first liquid supply unit 26 serving as a liquid supplying unit for supplying the UV ink to the inside of the sub-tank 25 from the main tank 15. The first liquid supply unit 26 includes a second ink supply tube 27 as a liquid supply passage, of which the upstream end portion 27*a* is located in the main tank 15 and the downstream end portion 27*b* is connected to the sub-tank 25, and a first pump 29 sucking the UV ink in the main tank 15 by the driving of the first driving motor 28 and discharging the UV ink to the sub-tank 25 side. In addition, the second ink supply tube 27 is provided with a first opening/closing valve (e.g., electro-magnetic valve) 30, which operates to allow or restrict flow of the UV ink between the tanks 15 and 25, at the sub-tank 25 side rather than the first pump 29.

The sub-tank 25 includes a substantially cylindrical tank body having a bottom surface, and a cover portion closing an opening portion of the tank body. The side wall of the sub-tank 25 is provided with a sub-side residual amount sensor 31 for detecting the capacity of the UV ink temporarily accommodated in the sub-tank 25. In a case where the liquid level A2 of the UV ink is at the same position as the installation position of the sub-side residual amount sensor 31 in the sub-tank 25 or is over the installation position, an "ON" signal is output from the sub-side residual amount sensor 31. In addition, the sub-tank 25 is provided with a first temperature sensor 32 for detecting the temperature of the UV ink in the sub-tank and a sub-tank heater 33 for heating the UV ink. Furthermore, the sub-tank 25 is connected to a compression/decompression unit 34 for compressing and decompressing the inside of the sub-tank 25.

The compression/decompression unit 34 includes a second pump 36 that drives to feed the gas to the inside of the sub-tank 25 by a second driving motor 35 to compress the inside of the sub-tank 25, and a second opening/closing valve (e.g., electro-magnetic valve) 37 that is in an open state in a case where the second pump 36 is driving or is in a closed state in a case where the second pump 36 is not driving. In addition, the compression/decompression unit 34 includes a third pump 39 that drives to exhaust the gas from the inside of the sub-tank 25 by a third driving motor 38 to decompress the inside of the sub-tank 25, and a pressure opening valve 40 for opening the inside of the sub-tank 25 in the atmosphere. Moreover, the compression/decompression unit 34 is provided with a third opening/closing valve (e.g., electro-magnetic valve) 41 that is in an open state in a case where at least one of the third pump 39 and the pressure opening valve 40 is driving and is in a closed state in a case where both the third pump 39 and the pressure opening valve 40 are not driving.

In addition, the printing section 12 is provided with an ink ejection unit 42 for ejecting the UV ink onto the target, and the ink ejection unit 42 has a plurality (four in this embodiment) of recording heads (liquid ejecting units) 43. Each of the recording heads 43 is provided with a pressure adjusting chamber (not illustrated) in the inside of the recording head. The UV ink in each of the pressure adjusting chambers is supplied to a plurality of nozzles (not illustrated) by the driving of a piezoelectric element (not illustrated), and then is appropriately ejected from each of the nozzles. In addition, each of the recording heads 43 is provided with a second temperature sensor 44 for detecting the temperature of the recording head, and a head heater 45 for keeping the UV ink in the pressure adjusting chamber warm.

Each of the recording heads 43 is supplied with the UV ink from the sub-tank 25 via a second liquid supply unit 46. The second liquid supply unit 46 includes a third ink supply tube 47 with the upstream end portion 47*a* located in the vicinity of the bottom portion of the sub-tank 25. The downstream side of the third ink supply tube 47 is connected to a plurality (four in this embodiment) of connection tubes 48 corresponding to each of the recording heads 43. Accordingly, in this embodiment, another liquid supply passage for supplying the UV ink to each of the recording heads 43 from the sub-tank 25 is formed by the third ink supply tube 47 and the connection tube 48. In addition, the third ink supply tube 47 is provided with a fourth pump 50 for sucking the UV ink from the sub-tank 25 side in accordance with the driving of the fourth driving motor 49 to discharge the UV ink to each of the recording heads 43 side. Moreover, the third ink supply tube 47 is provided with a fourth opening/closing valve (e.g., electro-magnetic valve) 51 that operates to allow or restrict the flow of the UV ink from the sub-tank 25 to each of the recording heads 43 side, and a damper 52 for damping fluctuation of the UV ink supplied by the fourth pump 50 at each of the recording heads 43 side rather than the fourth pump 50.

Each of the connector tubes 48 is configured in such a way that a passage sectional area of the connector tube is narrower than that of the third ink supply tube 47. The UV ink flowing in each of the connector tubes 48 is heated by a supply passage heater 54 that is controlled based on the detected signal from the third temperature sensor 53.

In addition, a plurality (four in this embodiment) ink circulation tubes 55 corresponding to each of the recording heads 43 is interposed between each of the recording heads 43 and the sub-tank 25. Each of the ink circulation tubes 55 is configured in such a way that the upstream end portion 55*a* of the ink circulation tube is connected to each of the recording heads 43 and the downstream end portion 55*b* is located in the sub-tank 25. Each of the ink circulation tubes 55 is provided with a fifth opening/closing valve (e.g., electro-magnetic valve) 56 that operates to allow or restrict the flow of the UV ink from each of the recording heads 43 side to the sub-tank 25 side.

In this instance, the printing section 12 includes a printing unit having the holder 14, each tanks 15 and 25, and the ink ejection unit 42 for each printing color as a configuration capable of ejecting UV ink of plural colors onto the target. However, only the printing unit for one color (e.g., white) will be described in this embodiment, and the description of the printing unit for other colors will be omitted for the sake of easy understanding of the specification.

Next, the ink cartridge 13 and the holder 14 will be described with reference to FIGS. 2A and 2B.

Figure 2A:
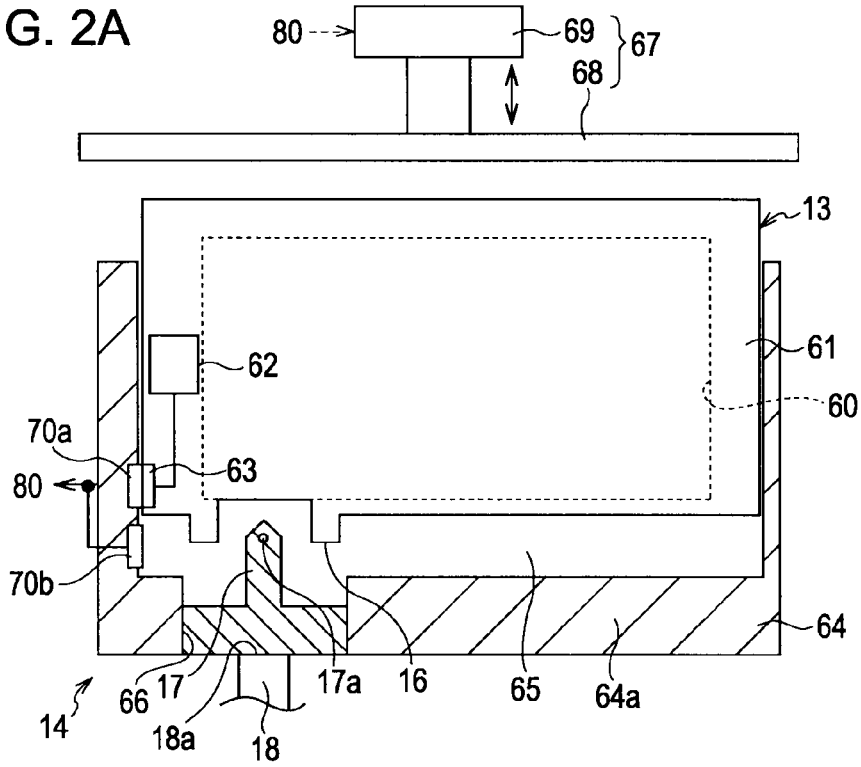
FIGS. 2A and 2B are diagrams schematically illustrating the configuration of a holder.
Figure 2B:
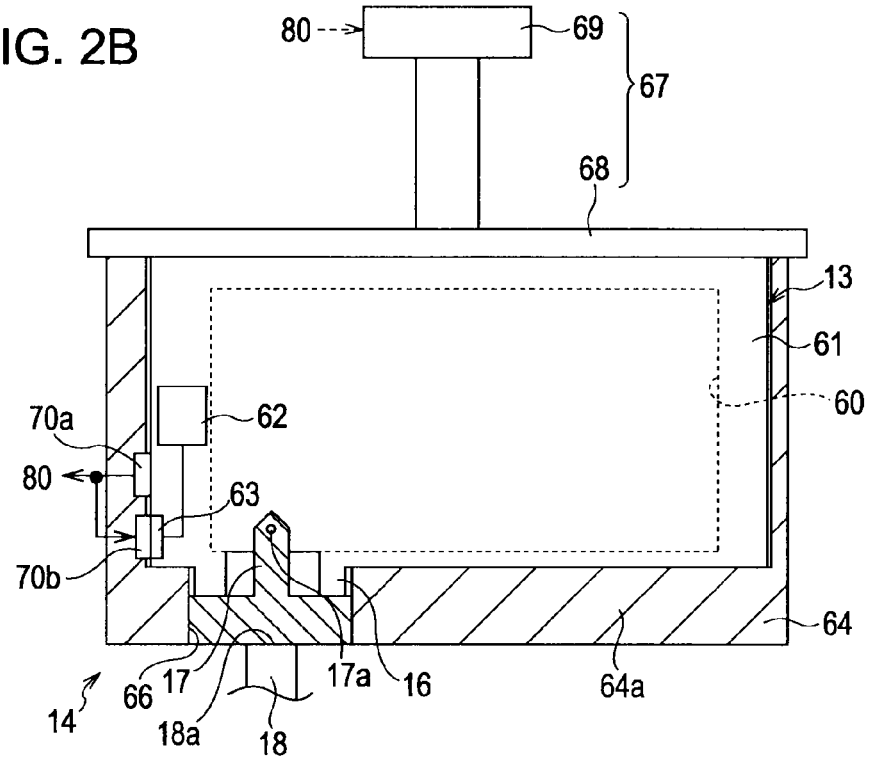

As shown in FIGS. 2A and 2B, the ink cartridge 13 includes a cartridge body 61 of a substantially rectangular parallelepiped shape which forms an ink storage chamber 60 (indicated by a dotted line in FIGS. 2A and 2B) for storing the UV ink therein. The bottom portion (left bottom portion in FIGS. 2A and 2B) of the cartridge body 61 is provided with the derivation portion 16 for deriving outwardly the UV ink from the ink storage chamber 60. In this instance, a film for suppressing volatility of the ink solvent is attached to the derivation portion 16 of the unused ink cartridge 13.

In addition, the cartridge body 61 is provided with an IC memory 62 in which various information such as the kinds of stored UV ink (color information or the like) and a storage amount is stored, and an electrode terminal 63 serving as an access terminal of the IC memory 62. In this instance, the IC memory 62 has a nonvolatile memory such as an EEPROM.

The holder 14 has a holder body 64, with an upper portion of FIG. 2A being opened. The holder body 64 is provided therein with an accommodation space 65 for accommodating the ink cartridge 13 therein. A through-hole 66 is formed to penetrate the bottom portion 64*a* of the holder body 64 at a position corresponding to the derivation portion 16 of the ink cartridge 13. The ink supply needle 17 is fitted into the through-hole 66. A communication hole 17*a* is formed in the front end side (upper end side in FIG. 2A) of the ink supply needle 17 to communicate the inner portion and the outer portion of the ink supply needle. In addition, the bottom portion 64*a* of the holder body 64 is provided with a biasing member (coil spring or the like) (not illustrated) for biasing the ink cartridge 13 in an upward direction. The ink cartridge 13 is located at a position (position shown in FIG. 2A) by the biasing force from the biasing member, in which the ink supply needle 17 is not possibly to be inserted into the derivation portion 16 of the ink cartridge 13. In this instance, the position of the ink cartridge 13 shown in FIG. 2A is referred to as a "standby position".

In addition, the holder 14 is provided with a pressing device 67 which is positioned over the holder body 64 in FIG. 2A and is driven based on a control command from a control device 80 which will be described later. The pressing device 67 includes a press member 68 that comes into contact with the ink cartridge 13 to apply a press force to the ink cartridge towards the lower side in FIG. 2A, and an attaching/detaching motor 69 to drive the press member 68 to advance and withdraw in an upward and downward direction in FIG. 2A. In a case where the ink cartridge 13 located at the standby position is pressed in a downward direction in FIG. 2A by driving of the pressing device 67, the ink cartridge 13 is moved in a downward direction against the biasing force from the biasing member. As a result, the ink supply needle 17 is inserted into the derivation portion 16 of the ink cartridge 13, as shown in FIG. 2B, and thus the UV ink of the ink storage chamber 60 is derived to the main tank 15 side via the ink supply needle 17 and the first ink supply tube 18. In this instance, the position of the ink cartridge 13 shown in FIG. 2B is referred to as a "mounting position".

The side wall of the holder 14 is provided with two contact terminals 70*a* and 70*b* which are located along upward and downward directions in FIGS. 2A and 2B, and each of the contact terminals 70*a* and 70*b* are electrically connected to the control device 80 which will be described later. In addition, in a case where the ink cartridge 13 is located at the standby position, the first contact terminal 70*a* of the contact terminals 70*a* and 70*b* which is positioned at the upper side is located at the position which comes into contact with the electrode terminal 63 of the ink cartridge 13. In a case where the ink cartridge 13 is located at the mounting position, the second contact terminal 70*b* which is positioned at the lower side is located at the position which comes into contact with the electrode terminal 63 of the ink cartridge 13. That is, even in the case where the ink cartridge 13 is located at the standby position or is located at the mounting position in this embodiment, if the ink cartridge 13 is mounted on the holder 14, various information stored in the IC memory 62 can be read by the control device 80.

Next, the internal configuration of the main tank 15 will be described with reference to FIG. 3.

Figure 3:
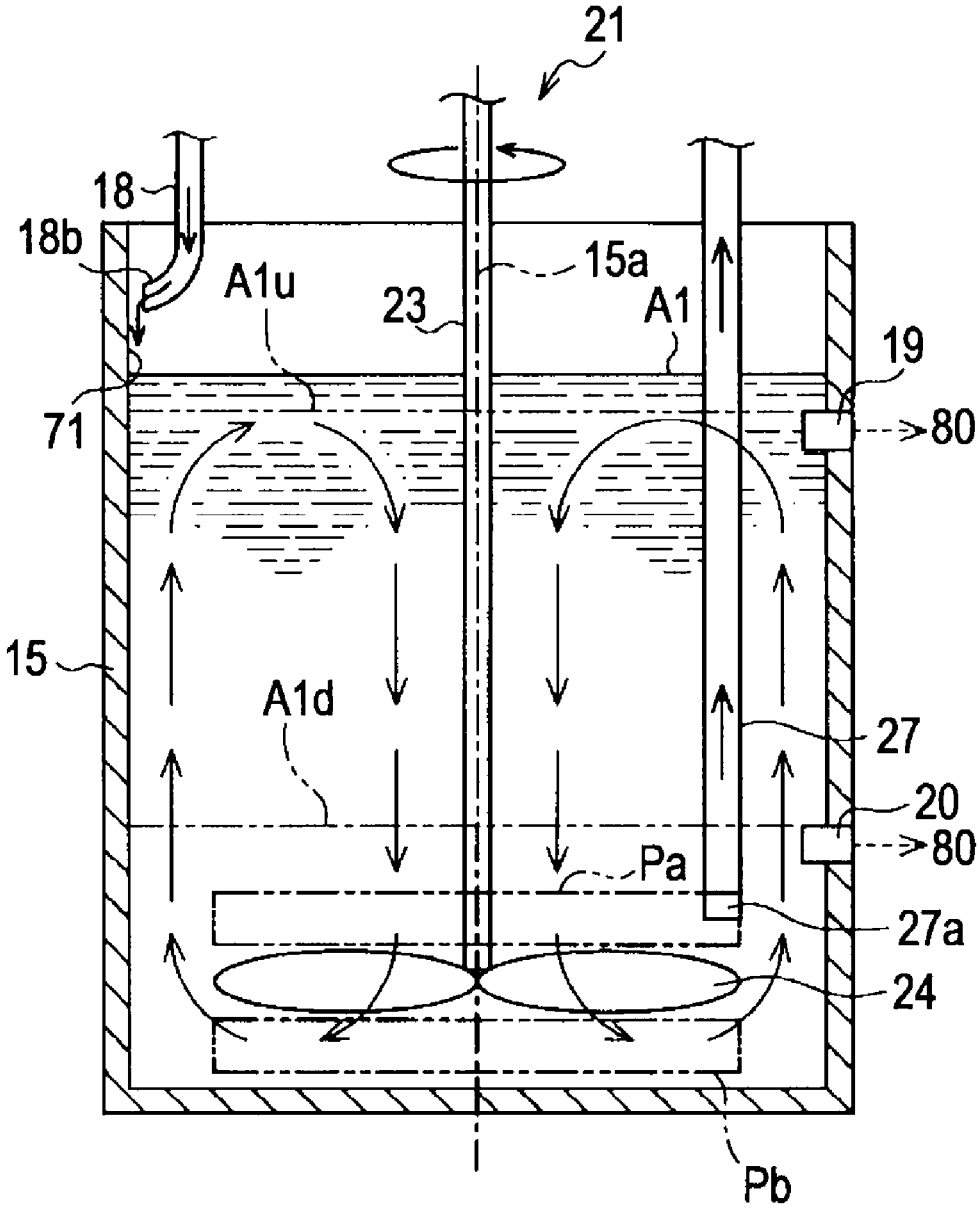
FIG. 3 is a sectional-side view schematically illustrating the internal configuration of a main tank.

As shown in FIG. 3, the first main-side residual amount sensor 19 which is positioned at the upper side of the main-side residual amount sensors 19 and 20 installed in the main tank 15 in the direction of gravity is located at the position in such a way that the main tank 15 can accommodate all the UV ink stored in one ink cartridge 13, in a case where the liquid level A1 of the UV ink accommodated in the main tank 15 is positioned at a position equal to the installation position of the first main-side residual amount sensor 19. In the case where the liquid level A1 of the UV ink in the main tank 15 is positioned at a position equal to or higher than the installation position of the first main-side residual amount sensor 19, an "ON signal" is output to the control device 80 from the first main-side residual amount sensor 19. In this embodiment, the capacity of the UV ink, in the case where the liquid level A1 of the UV ink in the main tank 15 is positioned at a position equal to the installation position of the first main-side residual amount sensor 19, is referred to as an "amount approximate to an upper limit", and in this instance, the liquid level A1 of the UV ink is referred to as a "level A1*u* approximate to the upper limit level".

In addition, the second main-side residual amount sensor 20 which is positioned at the lower side in the direction of gravity is located at the position in such a way that the UV ink is supplied from the main tank 15 to the sub-tank 25 side to fill the inside of the sub-tank 25 with the UV ink, in the case where the liquid level A1 of the UV ink accommodated in the main tank 15 is positioned at a position equal to the installation position of the second main-side residual amount sensor 20. In the case where the liquid level A1 of the UV ink in the main tank 15 is positioned at a position equal to or higher than the installation position of the second main-side residual amount sensor 20, an "ON signal" is output to the control device 80 from the second main-side residual amount sensor 20. In this embodiment, the capacity of the UV ink, in the case where the liquid level A1 of the UV ink is positioned at a position equal to the installation position of the second main-side residual amount sensor 20, is referred to as an "amount approximate to a lower limit", and in this instance, the liquid level A1 of the UV ink is referred to as a "level A1*d* approximate to lower limit".

The shaft member 23 of the agitation device 21 in the main tank 15 is located at the same position as a center line (indicated by a one-dotted chain line in FIG. 3) 15*a* of the main tank 15. That is, the shaft member 23 is located to be extended along the direction of gravity, and the front end (i.e., the lower end) of the shaft member 23 is positioned at a position lower than the installation position of the second main-side residual amount sensor 20. In a case where each of the blade members 24 installed at the front end of the shaft member 23 is rotated together with the shaft member 23 in the arrow direction shown in FIG. 3, the blade member is configured draw the UV ink from the upper portion of each of the blade members 24 and discharge it toward the lower portion of each blade member 24. That is, a suction pressure region Pa (region enclosed by the two-dotted chain line in FIG. 3), in which pressure is lower than the other region, is formed just over each blade member 24 in the main tank 15. In addition, a discharge pressure region Pb (region enclosed by the two-dotted chain line in FIG. 3), in which pressure is higher than the other region, is formed just below each blade member 24. As a result, convection of the UV ink indicated by an arrow in FIG. 3 is created in the main tank 15 to agitate the UV ink in the main tank 15.

In FIG. 3, the downstream end portion 18*b* of the first ink supply tube 18 is located at the left side of the shaft member 23 in FIG. 3, and is at a position higher than the installation position of the first main-side residual amount sensor 19 in the direction of weight. In addition, the downstream end portion 18*b* of the first ink supply tube 18 is bent so as to orient the sidewall (hereinafter referred to as "guide wall portion 71") positioned at the left side of the sidewalls of the main tank 15 in FIG. 3. The UV ink derived from the downstream end portion 18*b* of the first ink supply tube 18 is guided downwardly to the guide wall portion 71 of the main tank 15, and thus is dipped in the UV ink previously accommodated in the main tank 15. That is, the UV ink flows down along the guide wall portion 71 of the main tank 15. Accordingly, in this embodiment, the guide wall portion 71 functions as a guide portion for guiding downwardly the UV ink derived from the downstream end portion 18*b* of the first ink supply tube 18 in the direction of gravity. In this instance, the first ink supply tube 18 is configured to have flow passage resistance (e.g., a passage sectional area) against the UV ink in such a way that bubbles does not mix in the UV ink in the main tank 15 when the UV ink dips to the liquid level A1 through the guide wall portion 71.

In FIG. 3, a second ink supply tube 27 is disposed at the right side of the shaft member 23. That is, the upward end portion 27*a* of the second ink supply tube 27 is disposed at an opposite side of the downstream end portion 18*b* of the first ink supply tube 18, with the shaft member 23 being interposed between the second ink supply tube and the first ink supply tube. The upward end portion 27*a* of the second ink supply tube 27 is disposed over each blade member 24 in the direction of gravity, and is disposed below the installation position of the second main-side residual amount sensor 20. In this instance, the corresponding volume between the installation position of the second main-side residual amount sensor 20 and the installation position of the upstream end portion 27*a* of the second ink supply tube 27 is set to be slightly larger than the corresponding volume between the bottom portion of the sub-tank 25 and installation position of the sub-side residual amount sensor 31.

Next, the electric configuration of the printing unit 12 according to this embodiment will be described with reference to FIG. 4. In this instance, the portions requiring the supply of the UV ink from the ink cartridge 13 to the sub-tank 25 are mainly shown in FIG. 4, and illustrations of the other portions are omitted.

Figure 4:
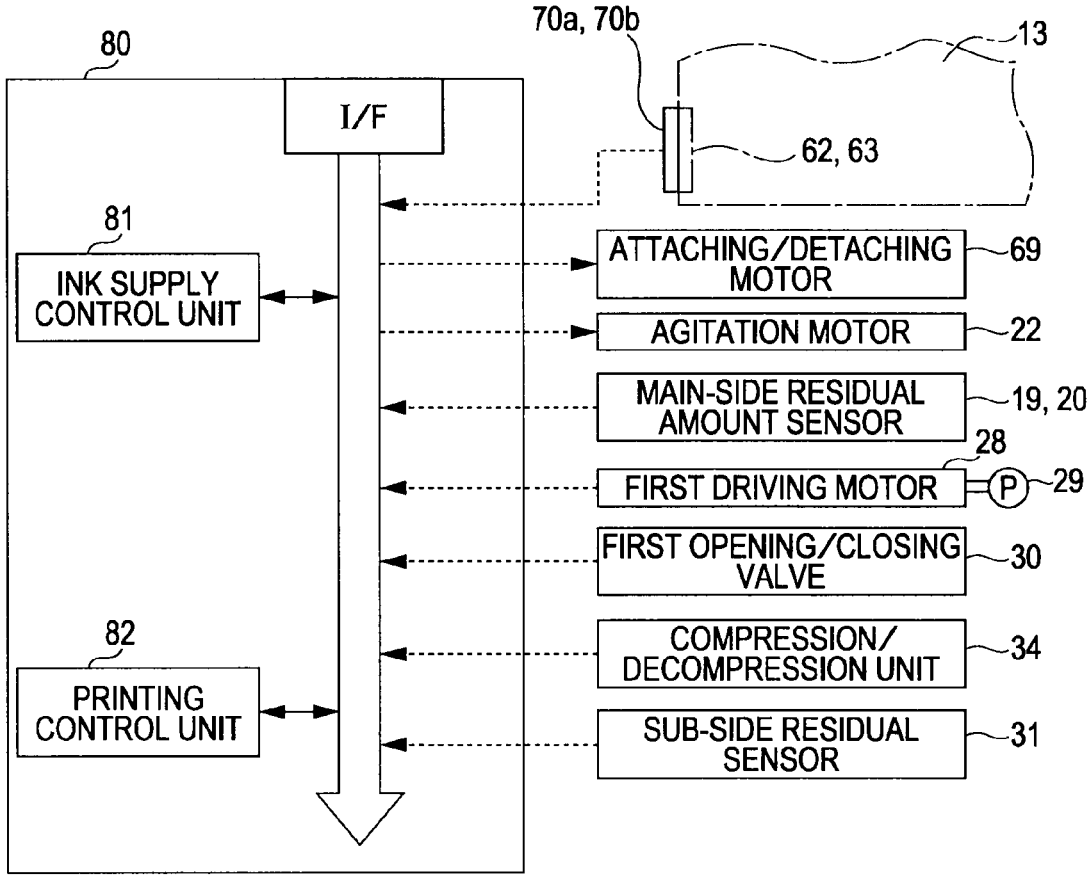
FIG. 4 is a block diagram illustrating an electric configuration.

As shown in FIG. 4, the input/output interface of the control device 80 is electrically connected with each contact terminal 70*a* and 70*b*, the attaching/detaching motor 69, the agitation motor 22, the first driving motor 28, the first opening/closing valve 30, the compression/decompression unit 34 and each residual amount sensor 19, 20 and 31. The control device 80 is provided with an ink supply control unit 81 mainly conducting the supply of the ink from the ink cartridge 13 to the sub-tank 25, and a printing control unit 82 mainly conducting the printing processing on the target. In addition, the control device 80 is provided with a driver circuit (not illustrated) for the attaching/detaching motor 69, a driver circuit (not illustrated) for the agitation motor 22, a driver circuit (not illustrated) for the first driving motor 28, a driver circuit (not illustrated) for the first opening/closing valve 30, and a driver circuit (not illustrated) for the compression/decompression unit 34.

The ink supply control unit 81 includes a CPU, a ROM and a RAM (not illustrated). In addition, the printing control unit 82 includes a CPU, a ROM, a RAM, an ASIC (Application Specific Integrated Circuit) (not illustrated) or the like.

Figure 5:
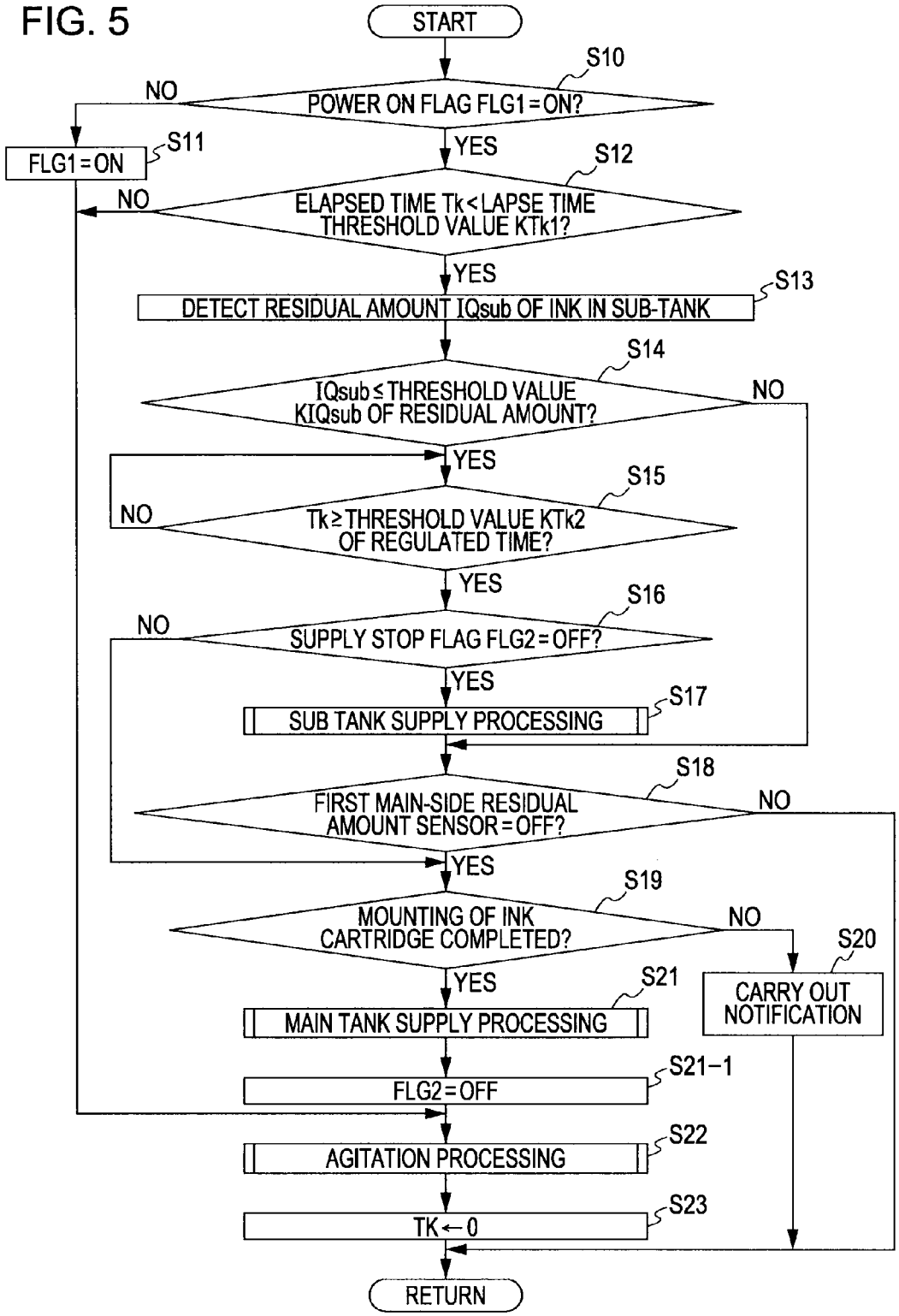
FIG. 5 is a flowchart illustrating a routine of processing ink supply.
Figure 6:
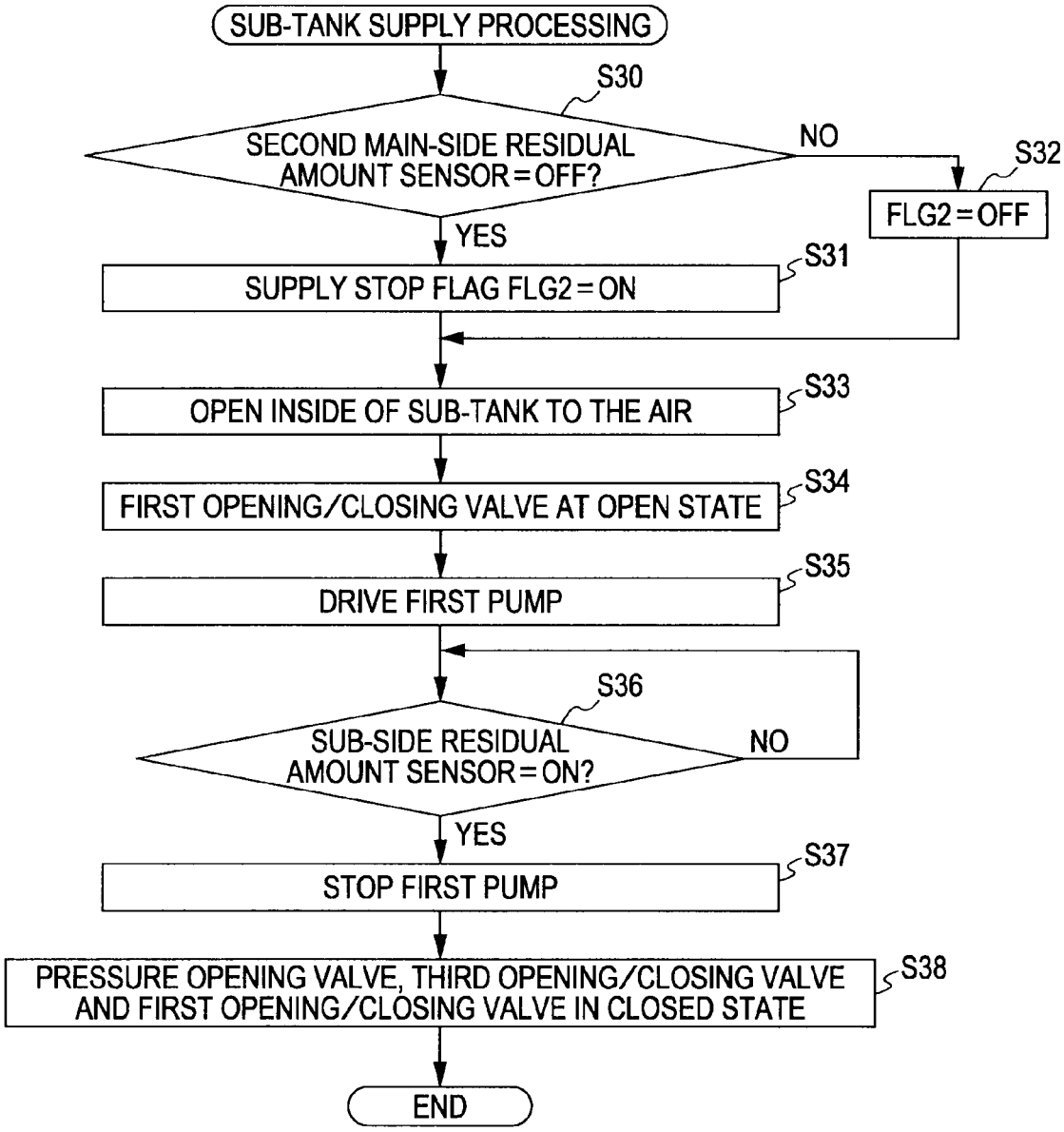
FIG. 6 is a flowchart illustrating a routine of processing a sub-tank.

Next, an ink supply processing routine which is executed by the ink supply control unit 81 of the control device 80 will be described with reference to a flowchart shown in FIGS. 5 and 6.

First, the ink supply control unit 81 executes the ink supply processing routine every predetermined desired cycle (e.g., one second). In the ink supply processing routine, the ink supply control unit 81 determines whether a power ON flag FLG1 is ON or not (step S10). The power ON flag FLG1 is a flag which is set to be ON in a case where the power of the printer 11 is turned ON and then the UV ink accommodated in the main tank 15 is agitated. If the determination result of step S10 is a negative determination (FLG1=OFF), the ink supply control unit 81 determines that agitation is not performed even once on the UV ink, sets the power ON flag FLG1 to ON (step S11), and then carries out the processing to step S22 which will be described below.

Meanwhile, if the determination result of step S10 is a positive determination (FLG1=ON), the ink supply control unit 81 determines whether or not an elapsed time Tk, after the agitation processing which will be described is finally performed, is less than a predetermined elapsed time threshold value KTk1 (e.g., a value corresponding to one week) (step S12). If the agitation on the UV ink in the main tank 15 is not performed during the time corresponding to the elapsed time threshold value KTk1, the UV ink pigment component may be settled in the main tank 15. Accordingly, the elapsed time threshold value KTk1 is a reference value to determine whether the sedimentation of the UV ink pigment component happens from the elapsed time Tk, and is set in advance by an experiment or simulation. If the determination result of step S12 is a negative determination (Tk≧KTk1), the ink supply control unit 81 determines that the sedimentation of the UV ink pigment component may have occurred in the main tank 15, and then carries out the processing to step S22 which will be described below.

Meanwhile, if the determination result of step S12 is a positive determination (Tk<KTk1), the ink supply control unit 81 detects the ink residual amount IQsub of the UV ink accommodated in the sub-tank 25 (step S13). More specifically, the ink supply control unit 81 detects the supply amount of the UV ink from the main tank 15 to the sub-tank 25 based on the driving velocity and driving time of the first pump 29. In addition, the printing control unit 82 performs the measurement on the ejection amount of the UV ink when the UV ink is ejected from the nozzle of each recording head 43. Accordingly, the ink supply control unit 81 obtains the ink residual amount IQsub in the sub-tank 25 by subtracting the total amount of the UV ink to be supplied to the sub-tank 25 from the main tank 15 by the total amount of the ink to be ejected from each recording head 43. Consequently, step S13 corresponds to the residual amount detection step in this embodiment.

Next, the ink supply control unit 81 determines whether the ink residual amount IQsub detected in step S13 is equal to or less than the predetermined residual amount threshold value KIQsub (step S14). The residual amount threshold value KIQsub is a reference value which is set in such a way that the liquid level A2 of the UV ink in the sub-tank 25 is not positioned below the upstream end portion 47*a* of the third ink supply tube 47, and is set in advance by an experiment or simulation. If the determination result of step S14 is a negative determination (IQsub>KIQsub), the ink supply control unit 81 determines that the capacity of the UV ink in the sub-tank 25 is sufficient, and then carries out the processing to step S18 which will be described below.

Meanwhile, if the determination result of step S14 is a positive determination (IQsub≦KIQsub), the ink supply control unit 81 determines whether or not the elapsed time Tk, after the agitation processing is finally performed, is equal to or more than a predetermined regulated time-threshold value KTk2 (step S15). If the UV ink in the main tank 15 is agitated by the agitation device 21, bubbles may be mixed with the UV ink. In a case where the UV ink is supplied from the main tank 15 to the sub-tank 25, the UV ink mixed with bubbles may be supplied to the sub-tank 25. If the UV ink mixed with bubbles is supplied to each recording head 43 from the sub-tank 25, ejection failure of the UV ink may happen. For this reason, after the agitation processing is performed, it would be better to wait until bubbles mixed with the UV ink are outwardly discharged. Accordingly, as a value corresponding to the standby time after the agitation processing in this embodiment, the regulation time threshold value KTk2 is set in advance.

If the determination result of step S15 is a negative determination (Tk<KTk2), the ink supply control unit 81 determines that bubbles may be still mixed with the UV ink in the main tank 15, and executes the determination processing of step S15 repeatedly until the determination result of step S15 is a positive determination. Meanwhile, if the determination result of step S15 is a positive determination (Tk≧KTk2), the ink supply control unit 81 determines whether a supply stop flag FLG2 is OFF or not (step S16). The supply stop flag FLG2 is a flag which is set to be ON in a case where it is determined that the supply of the UV ink to the sub-tank 25 is difficult since the residual amount of the ink in the main tank 15 is excessively small, that is, the capacity of the UV ink is sufficiently less than the amount approximate to the lower limit. If the determination result of step S16 is a negative determination (FLG2=ON), the ink supply control unit 81 restricts the supply of the UV ink to the sub-tank 25, and then carries out the processing to step S19 which will be described below. Meanwhile, if the determination result of step S16 is a positive determination (FLG2=OFF), the ink supply control unit 81 executes the sub-tank supply processing (will be described in detail in FIG. 6) to supply the UV ink to the sub-tank 25 (step S17), and then carries out the processing to next step S18. Accordingly, step S17 corresponds to the second supply step in this embodiment.

In step S18, the ink supply control unit 81 determines whether the detection signal from the first main-side residual amount sensor 19 is an OFF signal or not. That is, it is determined in step S18 whether or not the liquid level A1 of the UV ink in the main tank 15 is positioned at a position equal to or higher than the installation position of the first main-side residual amount sensor 19. In other words, in step S18, detected is the capacity of the UV ink in the main tank 15 based on the detection signal from the first main-side residual amount sensor 19. Accordingly, step S18 corresponds to the capacity detecting step in this embodiment.

If the determination result of step S18 is a negative determination, the ink supply control unit 81 determines that the capacity of the UV ink in the main tank 15 is equal to or more than the approximate amount of the predetermined upper limit, and thus completes first the ink supply processing routine without performing the supply of the ink to the main tank 15. Meanwhile, if the determination result of step S18 is a positive determination, the ink supply control unit 81 carries out the processing to next step S19.

In step S19, the ink supply control unit 81 determines whether or not the ink cartridge 13 stored with the UV ink therein is mounted on the holder 14. More specifically, the ink supply control unit 81 determines that the ink cartridge is mounted on the holder in a case where the information can be acquired from the IC memory 62 of the ink cartridge 13 through the contact terminal 70*a*. In this instance, the ink supply control unit 81 determines that the ink cartridge 13 is not mounted on the holder 14 in a case where the information indicating that the storage amount of the UV ink in the ink cartridge 13 is zero 0 or nearly zero 0 is detected from IC memory 62. If the determination result of step S19 is a negative determination, the ink supply control unit 81 carries out the notification processing of notifying a command of mounting the ink cartridge 13 on the holder 14 (step S20), and then first completes the ink supply processing routine. If the notification processing is performed, for example, the command of mounting the ink cartridge 13 on the holder 14 is displayed on a display screen of a computer, which is not illustrated, connected to the printer 11.

Meanwhile, the determination result of step S19 is a positive determination, the ink supply control unit 81 carries out the main tank supply processing to supply the UV ink to the main tank 15 (step S21). That is, the ink supply control unit 81 controls the driving of the attaching/detaching motor 69 to move the press member 68 in a downward direction and move the ink cartridge 13 positioned at the standby position to the mounting position. Then, in a case where the elapsed time after the ink cartridge 13 is disposed at the mounting position passes a predetermined time, the ink supply control unit 81 determines that all the UV ink in the ink cartridge 13 is supplied to the main tank 15. The ink supply control unit 81 controls the driving of the attaching/detaching motor 69 to move the press member 68 in an upward direction and move the ink cartridge 13 from the mounting position to the standby position, and then carries out the processing to the next step S21-1. Accordingly, the first supply step is constituted of steps S19 to S21 in this embodiment.

In step S21-1, the ink supply control unit 81 sets the supply stop flag FLG2 as OFF, and then carries out the processing to next step S22.

In step S22, the ink supply control unit 81 performs the agitation processing of agitating the UV ink in the main tank 15. More specifically, the ink supply control unit 81 controls the driving of the agitation motor 22 to rotate each blade member 24. In a case where the elapsed time, after each blade member 24 starts to rotate, passes the predetermined rotation time threshold value, the ink supply control unit 81 determines that the UV ink in the main tank 15 is sufficiently agitated, and then stops the agitation motor 22. Accordingly, step S22 corresponds to the agitation step in this embodiment.

Then, the ink supply control unit 81 resets the elapsed time Tk after completion of the final agitation process as zero 0 (step S23). After that, the ink supply control unit 81 just completes the ink supply processing routine.

Next, the sub-tank supply processing (sub-tank supply processing routine) will be described based on the flowchart shown in FIG. 6.

First, in the sub-tank supply processing routine, the ink supply control unit 81 determines whether the detection signal of the second main-side residual amount sensor 20 is an OFF signal or not (step S30). If the determination result is a positive determination, the ink supply control unit 81 determines that the capacity of the UV ink in the main tank 15 is equal to or less than the amount approximate to the lower limit, sets the supply stop flag FLG2 as ON (step S31), and then carries out the processing to step S33 which will be described below. If the determination result is a negative determination in step S30, the ink supply control unit 81 determines that the capacity of the UV ink in the main tank 15 is more than the amount approximate to the lower limit, sets the supply stop flag FLG2 as OFF (step S32), and then carries out the processing to next step S33.

In step S33, the ink supply control unit 81 operates the third opening/closing valve 41 and the pressure opening valve 40 to open the inside of the sub-tank 25 to the air. The ink supply control unit 81 operates the first opening/closing valve 30 in the open state (step S34), and then controls the first driving motor 28 to drive the first pump 29 (step S35). The ink supply control unit 81 determines whether the detection signal from the sub-side residual amount sensor 31 is an ON signal or not (step S36). If the determination result is a negative determination, the ink supply control unit 81 determines that the liquid level A2 of the UV ink in the sub-tank 25 is positioned at a position lower than the installation position of the sub-side residual amount sensor 31, and carries out the determination processing of step S36 repeatedly until the determination result of step S36 is the positive determination.

Meanwhile, if the determination result is a positive determination in step S36, the ink supply control unit 81 determines that the liquid level A2 of the UV ink in the sub-tank 25 is positioned at a position equal to or higher than the installation position of the sub-side residual amount sensor 31, and stops the first driving motor 28 to stop the first pump 29 (step S37). Then, the ink supply control unit 81 operates the pressure opening valve 40 and the third opening/closing valve 41 of the compression/decompression unit 34 in a closed state, and simultaneously operates the first opening/closing valve 30 in a closed state (step S38). After that, the ink supply control unit 81 completes the sub-tank supply processing routine.

Next, a method of supplying the UV ink in the printer 11 according to this embodiment will be described.

First, if the liquid level A1 of the UV ink in the main tank 15 is positioned at a position equal to or lower than the installation position of the first main-side residual amount sensor 19 in the direction of gravity, it starts to supply the UV ink to the main tank 15. That is, the ink cartridge 13 installed on the holder 14 moves from the standby position (refer to FIG. 2A) to the mounting position (refer to FIG. 2B) by the driving of the press device 67. The ink supply needle 17 is inserted into the derivation portion 16 of the ink cartridge 13, and the UV ink in the ink storage chamber 60 of the ink cartridge 13 is derived through the ink supply needle 17 and the first ink supply tube 18. In this instance, the UV ink derived from the downstream end portion 18*b* of the first ink supply tube 18 is guided in a downward direction along the guide wall portion 71 opposite to the downstream end portion 18*b*. As a result, when the UV ink supplied from the ink cartridge 13 dips to the liquid level A1 of the UV ink previously supplied to the main tank 15, it is possible to suppress bubbles from being mixed with the UV ink in the main tank 15.

If all the UV ink in the ink cartridge 13 is supplied to the main tank 15, the ink cartridge 13 installed at the mounting position is moved to the standby position, and the supply of the UV ink to the main tank 15 is completed. Then, the UV ink to be accommodated in the main tank 15 is agitated in the main tank 15. That is, each of the blade members 24 is rotated in a direction indicated by the arrow in FIG. 3 by the driving of the agitation motor 22. The suction pressure region Pa is formed in the region over each blade member 24, and simultaneously, the discharge pressure region Pb is formed in the region below each blade member 24. As a result, the convection of the UV ink indicated by the arrow in FIG. 3 is created in the main tank 15 to agitate the UV ink in the main tank 15. For this reason, although the pigment component has settled in the vicinity of the bottom portion of the main tank 15, the component ratio of the UV ink in the main tank 15 can be stabilized by the agitation processing using the agitation device 21. In this instance, the 'stabilization of the component ratio' herein indicates that the component ratios of the UV ink are substantially equal to each other at plural different positions in the main tank 15.

If the agitation processing is completed, bubbles may be mixed with the UV ink in the main tank 15 by the agitation. For this reason, until the time corresponding to the regulation time threshold value KTk2 passes after the agitation processing is completed, the supply of the UV ink from the main tank 15 to the sub-tank 25 side is restricted.

After that, if the liquid level A2 of the UV ink in the sub-tank 25 is positioned at the position substantially equal to the upstream end portion 47*a* of the second liquid supply unit 46 in the direction of gravity, the UV ink is supplied to the sub-tank 25 from the main tank 15. In this instance, the inside of the sub-tank 25 is opened to the air by the operation of the pressure opening valve 40 and the third opening/closing valve 41 of the compression/decompression unit 34. In this instance, if the first opening/closing valve 30 is opened and simultaneously the first pump 29 is driven, the UV ink in the main tank 15 is supplied to the sub-tank 25 through the second ink supply tube 27. Then, the liquid level A2 of the UV ink in the sub-tank 25 is gradually increased. If the liquid level A2 of the UV ink in the sub-tank 25 is positioned at the position equal to or higher than the installation position of the sub-side residual amount sensor 31, the supply of the UV ink to the sub-tank 25 is stopped. That is, the pressure opening valve 40 and the third opening/closing valve 41 of the compression/decompression unit 34 are in the closed state, and simultaneously, the driving of the first pump 29 is stopped. In addition, the first opening valve 30 is in the closed state.

In this instance, in a case where the supply start timing of the UV ink to the sub-tank 25 is overlapped with the supply start timing of the UV ink to the main tank 15, the supply of the UV ink to the sub-tank 25 is first carried out. That is, the supply of the UV ink to the sub-tank 25 is completed, and then the UV ink is supplied to the main tank 15. In addition, in a case where the ink cartridge 13 is not mounted on the holder 14 at the supply start timing of the UV ink to the main tank 15, a notification urging the user to mount the ink cartridge 13 is performed.

Consequently, the following effects can be obtained in this embodiment.

(1) It is possible to supply the UV ink to the main tank 15 from the ink cartridge 13. By agitating the UV ink supplied to the main tank 15, it is possible to suppress a portion (in this instance, the pigment component) of the UV ink component from being settled in the main tank 15. That is, it is possible to supply the UV ink with a uniform component ratio to the recording head 43. For this reason, it is possible to always eject the UV ink with a uniform component ratio onto the target, and stabilize the quality of the printed product (i.e., the target of the printing completing) by the printer 11.

(2) The UV ink in the ink cartridge 13 is supplied to the main tank 15 through the first ink supply tube 18 and the guide wall portion 71. In this instance, since the UV ink is guided in the downward direction by the guide wall portion 71, it is possible to suppress bubbles from being created in the UV ink in the main tank 15, when the UV ink dips to the liquid level A1 of the UV ink previously accommodated in the main tank 15. Accordingly, it is possible to suppress bubbles mixed with the UV ink from being supplied to the recording head 43 together with the UV ink. Also, it is possible to suppress generation of ejection failure of the UV ink by the recording head 43.

(3) In this embodiment, a portion (i.e., the guide wall portion 71) of the sidewall of the main tank 15 serves as a guide portion. For this reason, it is possible to simplify the whole apparatus as compared with the case in which a guide portion is installed separately from the sidewall in the main tank 15.

(4) In general, the UV ink pigment component may be settled in the lower portion of the main tank 15 rather than the blade member 24. For this reason, in the case where the upward end portion 27*a* of the second ink supply tube 27 is disposed at a position lower than the blade member 24, the pigment component precipitates, and thus UV ink with a component ratio differing from the regular component ratio may be supplied to the recording head 43 side. In this regard, the upward end portion 27*a* of the second ink supply tube 27 is disposed at the position higher than the blade member 24 in this embodiment. For this reason, it is possible to suppress the UV ink different from the regular component ratio from being supplied to the recording head 43 side.

(5) In addition, in this embodiment, the blade member 24 is rotated to generate convection as shown by the arrow in FIG. 3. For this reason, even though the pigment component has settled in the main tank 15, it is possible to solve the problem of the sedimentation appropriately.

(6) In the vicinity of the portion in which the UV ink from the ink cartridge 13 is dipped in the main tank 15, the component ratio of the UV ink may be different from the regular component ratio in accordance with the circumference in the ink cartridge 13. For this reason, by disposing the downstream end portion 18*b* of the first ink supply tube 18 at the position spaced apart from the upstream end portion 27*a* of the second ink supply tube 27, it is possible to suppress the UV ink with the component ratio from being supplied to the recording head 43 side.

(7) In this embodiment, even though the liquid level A1 of the UV ink is positioned at the position equal to the installation position of the second main-side residual amount sensor 20 in the main tank 15, the UV ink in the main tank 15 can be agitated by the rotation of the blade member 24. In addition, the UV ink in the main tank 15 can be supplied to the recording head 43 side. For this reason, it is possible to suppress the ejection of the UV ink onto the target from being stopped.

(8) In the case where the liquid level A1 of the UV ink in the main tank 15 is positioned at the position equal to or higher than the installation position of the first main-side residual amount sensor 19, the main tank 15 doesn't have the space to accommodate all the UV ink in the ink cartridge 13. For this reason, the supply of the UV ink to the main tank 15 is restricted. That is, the supply of the UV ink to the main tank 15 from the ink cartridge 13 little by little is avoided, and the UV ink with a uniform component ratio can be supplied to the recording head 43 side.

(9) In the case where the capacity of the UV ink in the sub-tank 25 is reduced, the UV ink in the main tank 15 is supplied to the sub-tank 25, and the UV ink is supplied to the recording head 43 from the sub-tank 25. That is, in the case where it is necessary to supply the ink to the sub-tank 25, it is possible to perform the supply of the UV ink to the sub-tank 25 from the main tank 15.

(10) Immediately after the UV ink is supplied to the main tank 15 from the ink cartridge 13, bubbles can be mixed with the UV ink accommodated in the main tank 15. For this reason, in the case where the supply start timing of the UV ink to the main tank 15 is overlapped with the supply start timing of the UV ink to the sub-tank 25, the supply of the UV ink to the sub-tank 25 is first carried out. Therefore, it is possible to suppress the supply of the UV ink mixed with bubbles to the sub-tank 25 side from the main tank 15.

(11) The agitation of UV ink in the main tank 15 is periodically carried out. For this reason, even though the UV ink is accommodated in the main tank 15 for a long time and thus the pigment component settles, it is possible to solve the problem of the sedimentation periodically.

(12) In this embodiment, the agitation processing is carried out when electric power is supplied to the printer 11. For this reason, even though the pigment component has settled in the main tank 15 while the power of the printer 11 is turned off, it is possible to solve the problem of the sedimentation of the pigment component in the main tank 15 by the agitation processing which is carried out immediately after the input of the electric power to the printer 11.

(13) In addition, in the case where the UV ink is supplied to the main tank 15 from the ink cartridge 13, the component ratios of the UV ink may be different at each position in the main tank 15. Accordingly, in this embodiment, the agitation processing is carried out when supplying the UV ink to the main tank 15. For this reason, the UV ink with a uniform component ratio can be supplied to the recording head 43 side.

(14) In this embodiment, the UV ink is temporarily accommodated in the sub-tank 25 from the main tank 15, and then is supplied to the recording head 43. For this reason, even though the UV ink supplied from the main tank 15 is mixed with bubbles, bubbles are outwardly discharged from the UV ink while the UV ink is temporarily accommodated in the sub-tank 25. Therefore, it is possible to suppress the supply of the UV ink mixed with bubbles to the recording head 43, and thus it is possible to suppress the generation of ejection failures of the UV ink.

In this instance, the embodiment may be altered into the following embodiments.

In an embodiment, the notification processing may be notification by sound.

In an embodiment, the printing unit 12 may include a plurality of sub-tanks 25 each corresponding to each recording head 43. In this instance, the first liquid supply unit 26 may be formed for each sub-tank 25.

In an embodiment, the sub-tank 25 may be omitted from the printing unit 12. In this instance, each of the recording heads 43 is directly supplied with the UV ink from the main tank 15.

In an embodiment, as the sensor for detecting the capacity of the accommodated UV ink, a float sensor may be installed in the main tank 15. With this configuration, it is possible to appropriately detect the capacity of the UV ink in the main tank 15.

In an embodiment, the main tank 15 may be provided with an arbitrary number of, that is, three or more, residual amount sensors. In this instance, each of the residual amount sensors may be disposed at different positions in the direction of gravity.

In an embodiment, the sub-tank 25 may be provided with an arbitrary number of, that is, two or more (e.g., 2), residual amount sensors. In this instance, each of the residual amount sensors may be disposed at different positions in the direction of gravity.

In an embodiment, the upstream end portion 27*a* of the second ink supply tube 27 may be disposed at a position in the vicinity of the downstream end portion 18*b* of the first ink supply tube 18. With the configuration, since the UV ink sufficiently agitated in the main tank 15 is supplied to the sub-tank 25 via the second ink supply tube 27, the UV ink with the uniform component can be supplied to the recording head 43 side.

In an embodiment, the blade member 24 may be configured to rotate so as to generate the suction pressure region Pa at a lower portion and generate the discharge pressure region Pb at an upper portion.

In an embodiment, the agitation device 21 may be arbitrarily configured if the UV ink in the main tank 15 can be agitated. For example, the agitation device 21 may include a rotator disposed in the main tank 15, and a driving source for generating a magnetic field at an outer portion of the main tank 15 to rotate the rotator in the main tank 15. In addition, the agitation device 21 may agitate the UV ink in the main tank 15 by transferring ultrasonic waves or mechanical vibrations to the main tank 15. Moreover, the agitation device 21 may include a pump for forcibly fluidizing the UV ink into the main tank 15.

In an embodiment, the downstream end portion 18*b* of the first ink supply tube 18 may not be opposite to the sidewall of the main tank 15. In this instance, it is preferable that the main tank 15 is provided therein with a guide portion for guiding the UV ink derived from the downstream end portion 18*b* of the first ink supply tube 18 such that the UV ink dips to the liquid level A1 of the UV ink previously accommodated in the main tank 15. In the case where the guide portion is installed, the downstream end portion 18*b* of the first ink supply tube 18 may be disposed at the outside of the main tank 15.

In an embodiment, the UV ink derived from the downstream end portion 18*b* of the first ink supply tube 18 may be supplied to the inside of the main tank 15 without passing through the guide portion. In this instance, when the UV ink is supplied to the inside of the main tank 15, the UV ink may be mixed with bubbles, but after the agitation processing, the supply restriction period of the UV ink to the sub-tank 25 side is set. For this reason, with the above configuration, it is possible to suppress the supply of the UV ink mixed with bubbles to the sub-tank 25 side.

In an embodiment, the holder 14 may be configured such that the ink supply needle 17 is inserted into the derivation portion 16 of the ink cartridge 13 mounted on the holder 14. In this instance, the flow passage of the first ink supply tube 18 may be provided with an opening/closing valve which is opened and closed in accordance with the control command from the control device 80. Therefore, when the UV ink is supplied to the main tank 15, the opening/closing valve is opened.

In an embodiment, the main tank 15 may be disposed at a position higher than the ink cartridge 13 mounted on the holder 14 in the direction of gravity. In this instance, the flow passage of the first ink supply tube 18 may be provided with a pump which is driven when the UV ink is supplied to the main tank 15.

In an embodiment, the ink cartridge 13 disposed at the standby position may be manually disposed at the mounting position. In this instance, it is preferable that the notification of disposing the ink cartridge 13 at the mounting position is performed with respect to the user at the start timing of the first supply step.

In an embodiment, in the case where the printing is not performed towards a target, the UV ink can be supplied to the sub-tank 25 side from the main tank 15, irrespective of the elapsed time after the agitation processing is completed. In this instance, even though the UV ink mixed with bubbles is supplied to the inside of the sub-tank 25, it is possible to naturally discharge outward the bubbles contained in the UV ink while the UV ink is temporarily accommodated in the sub-tank 25.

In an embodiment, the agitation step may be initiated while the first supply step is performed.

In an embodiment, in a case where the elapsed time Tk after the agitation processing can be measured while the power of the printer 11 is turned off, the agitation processing may not necessarily be performed when the electric power is input to the printer 11. That is, in a case where the elapsed time Tk is less than the elapsed time threshold value KTk1 when the electric power is input to the printer 11, the agitating processing may not be performed. In this instance, it is possible to quickly initiate the printing processing with respect to the target.

In an embodiment, the sub-tank 25 may be provided with an arbitrary number (e.g., two) of at least two residual amount sensors. In this instance, in the case where the liquid level A2 of the UV ink is positioned at the position lower than the installation position of the residual amount sensor disposed at the lower side, the second supply step may be performed.

In an embodiment, the liquid storage unit for storing the UV ink may be formed in a drum or an envelope.

In this embodiment, although the printer 11 using the UV ink is exemplified, the invention is not limited thereto. A printer using other pigment ink may be exemplified. That is, a printer with ink, in which a portion of the components has settled during long reservation, may be exemplified.

In the above-described embodiment, although the ink jet-type printer 11 is exemplified as the liquid ejecting apparatus, aspects of the invention may be embodied as a liquid ejecting apparatus that ejects or discharges a liquid other than ink (including a liquid body in which particles of functional material are dispersed or mixed, liquid and a flowage body such as gel). For example, the liquid ejecting apparatus may be a liquid body ejecting apparatus that ejects a liquid body in which a material such as an electrode material or a color material (pixel material), which is used for manufacturing a liquid crystal display, an EL (electroluminescent) display, or a surface emitting display, is dispersed or dissolved, a liquid ejecting apparatus that ejects a bio organic used to manufacture bio chips, or a liquid ejecting apparatus that is used as a precision pipette to eject a sample of liquid. Furthermore, the liquid ejecting apparatus may be a liquid ejecting apparatus that ejects a pinpoint of a lubricant onto a precision machine such as watch or camera, a liquid ejecting apparatus that ejects a transparent resin liquid, such as an ultraviolet curing resin, for forming a microscopic semi-spherical lens (optical lens) used for an optical communication element, or the like, on a substrate, a liquid ejecting apparatus that ejects an etching solution such as acid or alkali to etch a substrate or the like, or a flowage body ejecting apparatus that ejects flowage body such as gel (e.g., physical gel). The invention may be applied to any one of the liquid ejecting apparatuses.

What is claimed is:

1. A liquid supply method of a liquid ejecting apparatus including a tank having a liquid capacity greater than that of a liquid storage unit, an agitation device that agitates liquid accommodated in the tank, and a liquid ejection unit that ejects the liquid supplied from the tank side, the liquid supply method comprising the steps of:

firstly supplying all the liquid in the liquid storage unit to the tank;

agitating the liquid accommodated in the tank by the agitation device; and secondly supplying the liquid in the tank to the liquid ejection unit.

2. The liquid supply method according to claim 1, wherein the tank is configured to have a size which can accommodate all the liquid in the liquid storage unit in a case where a capacity of the liquid in the tank is equal to or less than an amount approximate to a predetermined upper limit, and wherein the liquid supply method further comprises the steps of detecting the capacity of the liquid in the tank; and the step of firstly supplying is executed in a case where a detection result at the step of detecting the capacity is equal to or less than the approximate amount of the predetermined upper limit.

3. The liquid supply method according to claim 1, wherein the liquid ejecting apparatus includes another tank disposed between the tank and the liquid ejection unit in the liquid supply direction, and wherein the liquid supply method further comprises the step of detecting a residual amount of the liquid accommodated in the another tank; and in the step of secondarily supplying, the liquid in the tank is supplied to the another tank based on the detection result at the step of detecting the residual amount.

4. The liquid supply method according to claim 1, wherein the tank is configured to have a size which can accommodate all the liquid in the liquid storage unit in a case where the capacity of the liquid in the tank is equal to or less than the approximate amount of the predetermined upper limit, and wherein the liquid supply method further comprises the step of detecting the capacity of the liquid in the tank; and the step of secondarily supplying is executed in preference to the step of firstly supplying, when it is determined that supply of the liquid to another tank is necessary based on the detection result at the step of detecting the residual amount, in a case where the detection result at the step of detecting the capacity is equal to or less than the approximate amount of the predetermined upper limit.

5. The liquid supply method according to claim 1, wherein the step of agitating is executed before an elapsed time, after the step of agitating is last executed, lapses a predetermined elapsed time threshold value.

6. The liquid supply method according to claim 1, wherein the step of agitating is executed at least one timing of a time that electric power is supplied to the liquid ejecting apparatus or a time that the liquid is supplied to the tank from the liquid storage unit.

7. The liquid supply method according to claim 1, wherein the step of secondarily supplying is regulated when an elapsed time, after the step of agitating is completed, is less than a predetermined regulated time threshold value.

8. The liquid supply method according to claim 1, wherein in the step of firstly supplying, in a case where the liquid storage unit is mounted on a holder of the liquid ejecting apparatus, all the liquid in the liquid storage unit mounted on the holder is supplied to the tank, and in a case where the liquid storage unit is not mounted on a holder of the liquid ejecting apparatus, notification of prompting a user to mount the liquid storage unit on the holder is carried out.

* * * * *